US008099013B2

(12) United States Patent
Okimura et al.

(10) Patent No.: US 8,099,013 B2
(45) Date of Patent: Jan. 17, 2012

(54) IMAGE FORMING APPARATUS AND IMAGE FORMING UNIT INCLUDING SEALING MEMBER

(75) Inventors: Naomasa Okimura, Saitama (JP); TaeSung Kim, Saitama (JP)

(73) Assignee: Fuji Xerox Co., Ltd, Tokyo (JP)

( * ) Notice: Subject to any disclaimer, the term of this patent is extended or adjusted under 35 U.S.C. 154(b) by 779 days.

(21) Appl. No.: 12/050,975

(22) Filed: Mar. 19, 2008

(65) Prior Publication Data

US 2008/0310878 A1 Dec. 18, 2008

(30) Foreign Application Priority Data

Jun. 18, 2007 (JP) ..... 2007-160106

(51) Int. Cl.
*G03G 15/08* (2006.01)

(52) U.S. Cl. ..... 399/103; 399/105; 399/110

(58) Field of Classification Search ..... 399/91, 399/98, 102–103, 105, 110
See application file for complete search history.

(56) References Cited

U.S. PATENT DOCUMENTS

| | | | | | |
|---|---|---|---|---|---|
| 3,999,654 | A * | 12/1976 | Pollack | 206/216 |
| 4,895,104 | A * | 1/1990 | Yoshino et al. | 399/106 |
| 5,075,727 | A * | 12/1991 | Nakatomi | 399/103 |
| 5,150,807 | A * | 9/1992 | Seyfried et al. | 399/106 |
| 5,153,650 | A * | 10/1992 | Maeshima | 399/106 |
| 5,311,265 | A * | 5/1994 | Miller | 399/106 |
| 5,434,656 | A * | 7/1995 | Nagaoka et al. | 399/106 |
| 5,585,902 | A * | 12/1996 | Nishiuwatoko et al. | 399/106 |
| 5,745,822 | A * | 4/1998 | Nishimura et al. | 399/106 |
| 5,907,747 | A * | 5/1999 | Diener | 399/109 |
| 7,826,765 | B2 * | 11/2010 | Kuba | 399/106 |
| 2005/0249519 | A1 * | 11/2005 | Chadez | 399/106 |
| 2006/0228131 | A1 * | 10/2006 | Kimura et al. | 399/111 |
| 2007/0071482 | A1 | 3/2007 | Okabe et al. | |
| 2008/0253803 | A1 * | 10/2008 | Nittani et al. | 399/114 |
| 2010/0196048 | A1 | 8/2010 | Okabe et al. | |
| 2011/0142491 | A1 * | 6/2011 | Numata et al. | 399/111 |
| 2011/0176828 | A1 * | 7/2011 | Lee et al. | 399/103 |

FOREIGN PATENT DOCUMENTS

JP 62-977 A 1/1987

(Continued)

OTHER PUBLICATIONS

English translation of Hayakawa (JP 63-210951).*

(Continued)

*Primary Examiner* — David Gray
*Assistant Examiner* — Geoffrey Evans
(74) *Attorney, Agent, or Firm* — Sughrue Mion, PLLC

(57) ABSTRACT

An image forming apparatus includes an image forming unit. The image forming unit is detachable with respect to the image forming apparatus. The image forming unit includes a development part, a developer accommodation part, a connection part and a sealing member. The development part develops an electrostatic latent image held on an image holding body by a developer. The developer accommodation part accommodates the developer. The connection part connects the development part and the developer accommodation part. The sealing member unsealably seals the connection part. The sealing member is drawable to outside the image forming apparatus in a direction intersecting with a detaching direction of the image forming unit in such a state that the image forming unit is held therein.

12 Claims, 5 Drawing Sheets

FOREIGN PATENT DOCUMENTS

| | | | |
|---|---|---|---|
| JP | 63-210951 | A | 9/1988 |
| JP | 08-234522 | A | 9/1996 |
| JP | 11-84845 | A | 3/1999 |
| JP | 2003-241508 | A | 8/2003 |
| JP | 2005-25080 | A | 1/2005 |
| JP | 2006-071671 | A | 3/2006 |
| JP | 2006-171407 | A | 6/2006 |
| JP | 2007-93830 | A | 4/2007 |

OTHER PUBLICATIONS

Office Action issued Jul. 9, 2010 in counterpart Chinese Application No. 200810085564.4.

Japanese Office Action issued on Sep. 20, 2011 in the corresponding Japanese Patent Application No. 2007-160106.

* cited by examiner

IMAGE FORMING APPARATUS AND IMAGE FORMING UNIT INCLUDING SEALING MEMBER

CROSS-REFERENCE TO RELATED APPLICATIONS

This application is based on and claims priority under 35 USC 119 from Japanese Patent Application No. 2007-160106 filed Jun. 18, 2007.

BACKGROUND

1. Technical Field

The present invention relates to an image forming apparatus and an image forming unit.

2. Related Art

Conventionally, as a unit integrally formed of various functional members for use in an image forming apparatus, there is a detachable unit (which may also be referred to as a cartridge) attachable to and detachable from an image forming apparatus.

Herein, the image forming apparatuses are, for example, the ones each of which forms an image on a recording medium using an electrophotographic image forming method. These include a copier, a printer (such as a laser printer or a full-color printer), a facsimile apparatus, and the like.

The various functional members are members for use in an image forming process. For example, the functional member is an image holding body member and a member for transfer, cleaning, charge elimination, and the like. In these units, it is known that the units having a developer in the inside thereof and including a developer accommodating part. During shipment, the developer accommodating part is rendered in a closed state so as to prevent the developer from being scattered. And immediately before mounting in a body of the image forming apparatus (i.e., before using), the developer accommodating part is released from the closed state.

As the member let the developer accommodating part be in the closed state, a sealing member is often used.

For example, the sealing member seals between the initial developer accommodation part and the toner accommodation part. As result of peeling off the sealing member and thereafter mounting the cartridge in the body of image forming apparatus, driving of the developer sleeve is started, which allows the initial developer to be loaded on the developer sleeve surface.

Incidentally, for the image forming apparatus, the unit and the image forming apparatus may be separately packed. However, the following case has often occurred. For factory shipment, the unit is packed (packed together) in a state mounted in the body of the image forming apparatus. This reduces the packing volume, which improves the transport efficiency and the like.

For the image forming apparatus delivered in such a state to a user, the unit is removed from the body once in order to carry out the peeling off operation (or the drawing out operation, i.e., sealing release) of the sealing member for use.

However, a user unfamiliar with the structure of the image forming apparatus is required to carry out the operation affecting the apparatus inside. The user may touch other members carelessly.

Further, the user may also touch by mistake a site on which oil components such as fingerprints, dust, and the like are not desired to be deposited (a site which may cause image deterioration and the like) of the unit, or may damage the site.

SUMMARY

According to an aspect of the invention, an image forming apparatus includes an image forming unit. The image forming unit is detachable with respect to the image forming apparatus. The image forming unit includes a development part, a developer accommodation part, a connection part, a sealing member. The development part develops an electrostatic latent image held on an image holding body by a developer. The developer accommodation part accommodates the developer. The connection part connects the development part and the developer accommodation part. The sealing member unsealably seals the connection part. The sealing member is drawable to outside the image forming apparatus in a direction intersecting with a detaching direction of the image forming unit in such a state that the image forming unit is held therein.

BRIEF DESCRIPTION OF THE DRAWINGS

Exemplary embodiments of the present invention will be described in detail based on the following figures, wherein.

DETAILED DESCRIPTION

Figure 1:
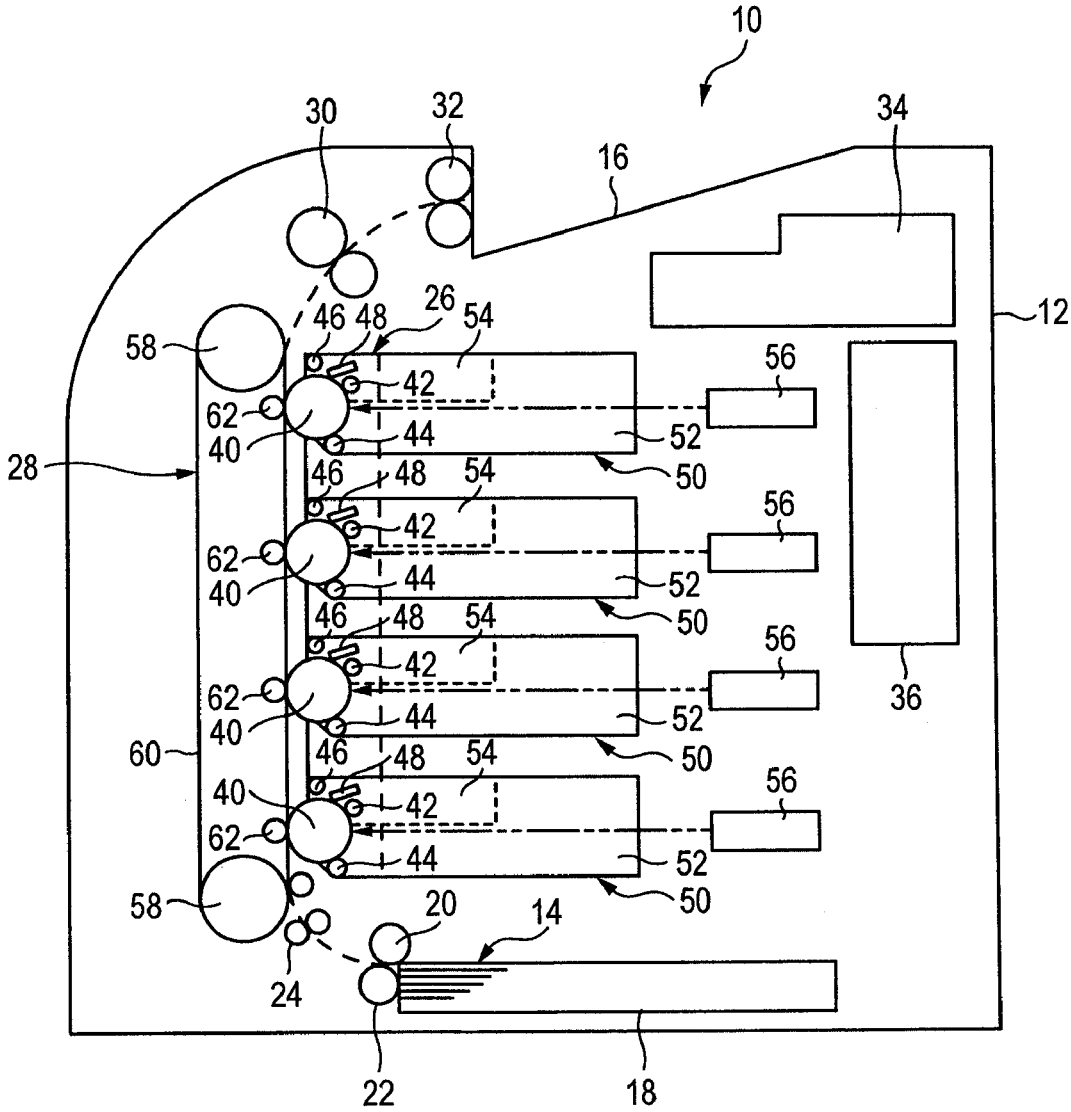
FIG. 1 is a configuration view showing an image forming apparatus in accordance with an exemplary embodiment of the present invention.

Below, exemplary embodiments of the present invention will be described by reference to the accompanying drawings. Herein, in the accompanying drawings, the same members are given the same reference numerals and signs. Further, an overlapped description is omitted. Incidentally, the description herein is on the best mode for carrying out the invention. Therefore, the invention is not limited to the embodiments.

Figure 2A:
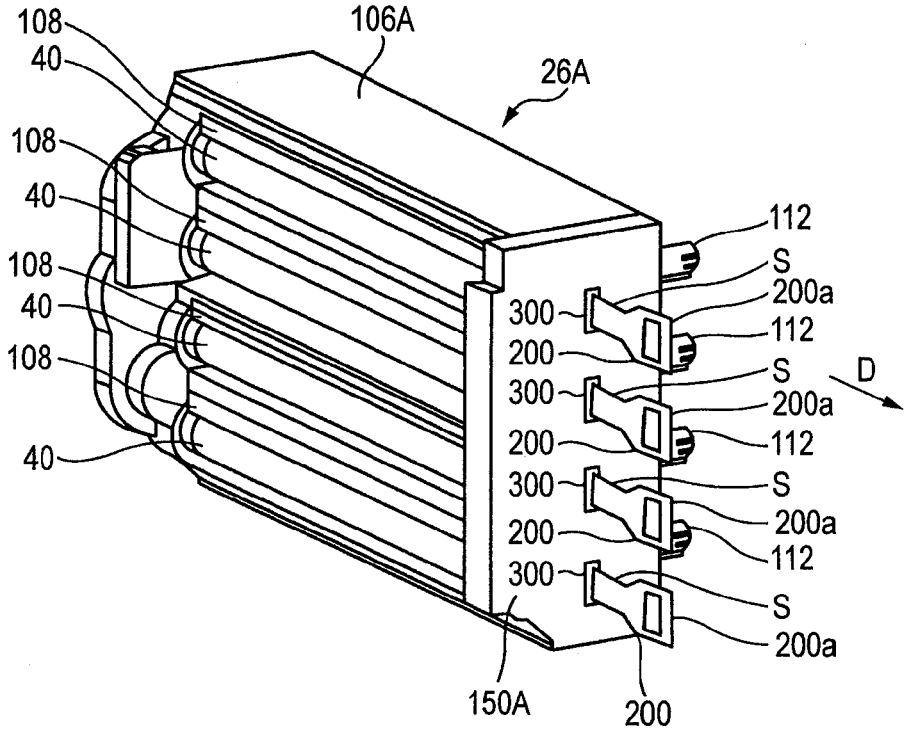
FIGS. 2A and 2B are a perspective view showing an image holding body unit in accordance with a first exemplary embodiment, and a perspective view showing an image forming apparatus accommodating the image holding body unit therein.
Figure 2B:
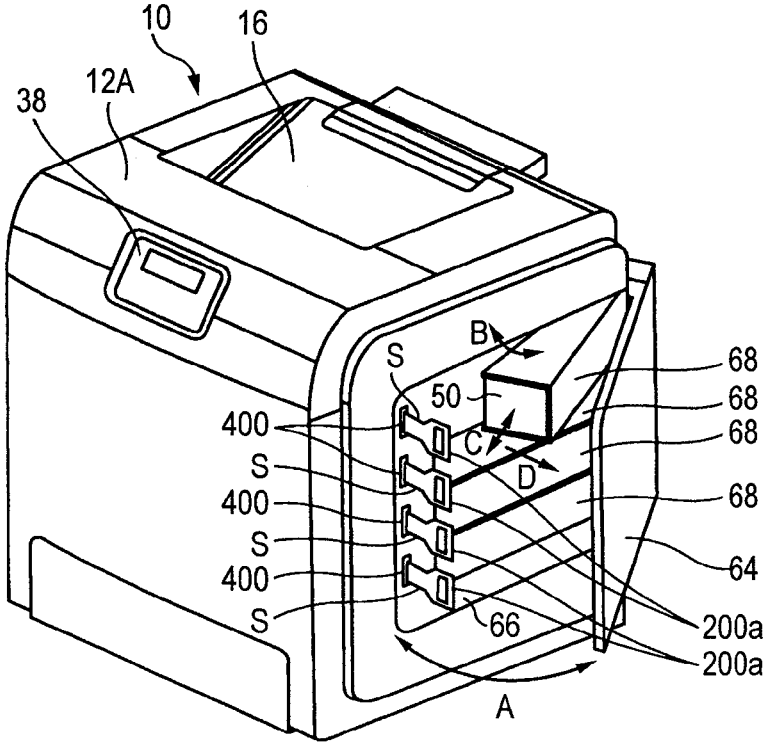
Figure 3A:
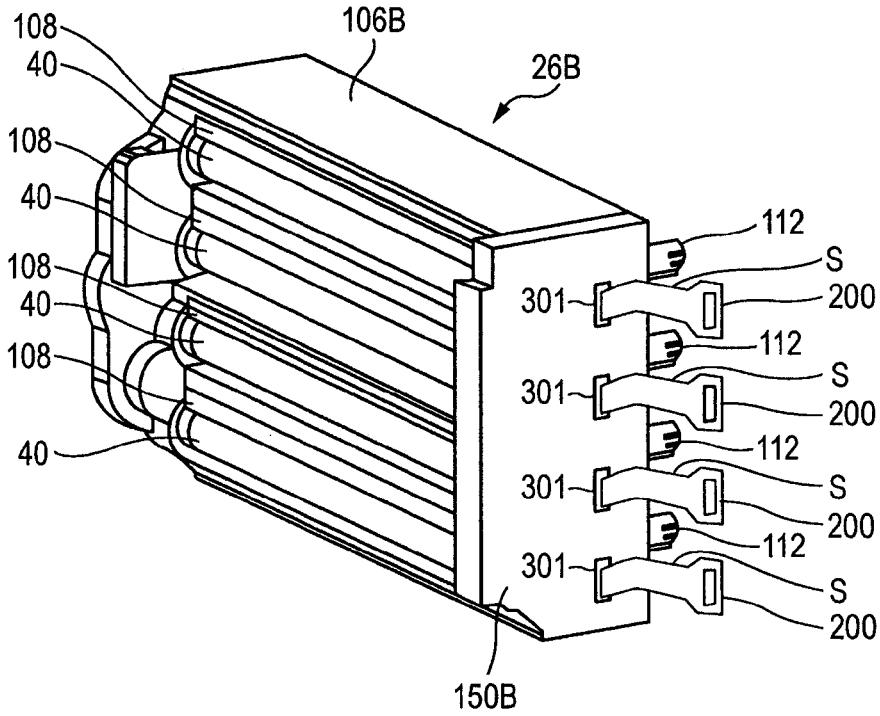
FIGS. 3A and 3B are a perspective view showing an image holding body unit in accordance with a second exemplary embodiment, and a perspective view showing an image forming apparatus accommodating the image holding body unit therein.
Figure 3B:
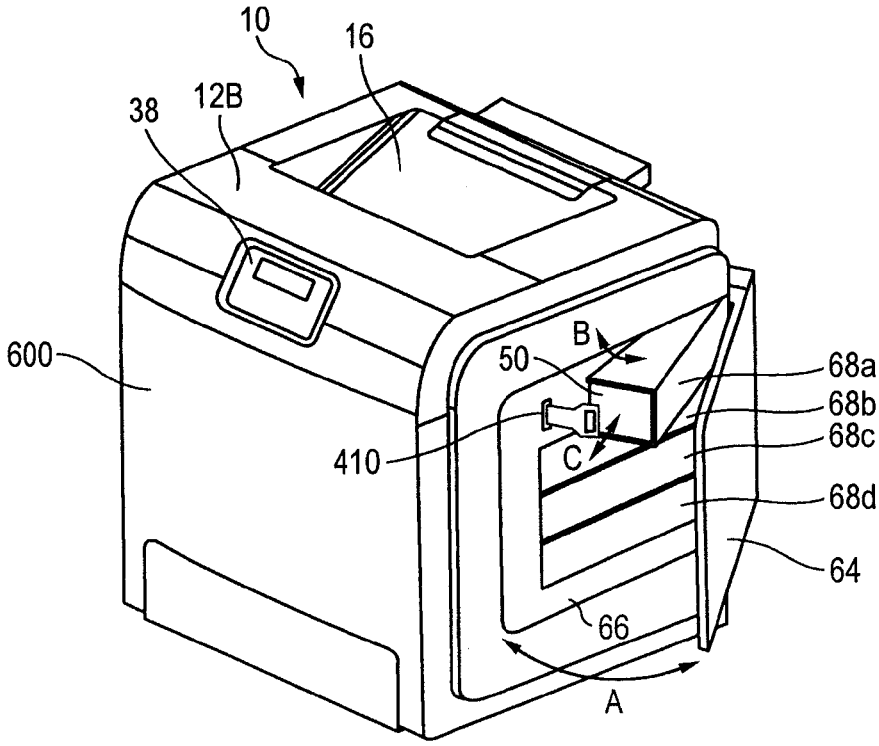
Figure 4A:
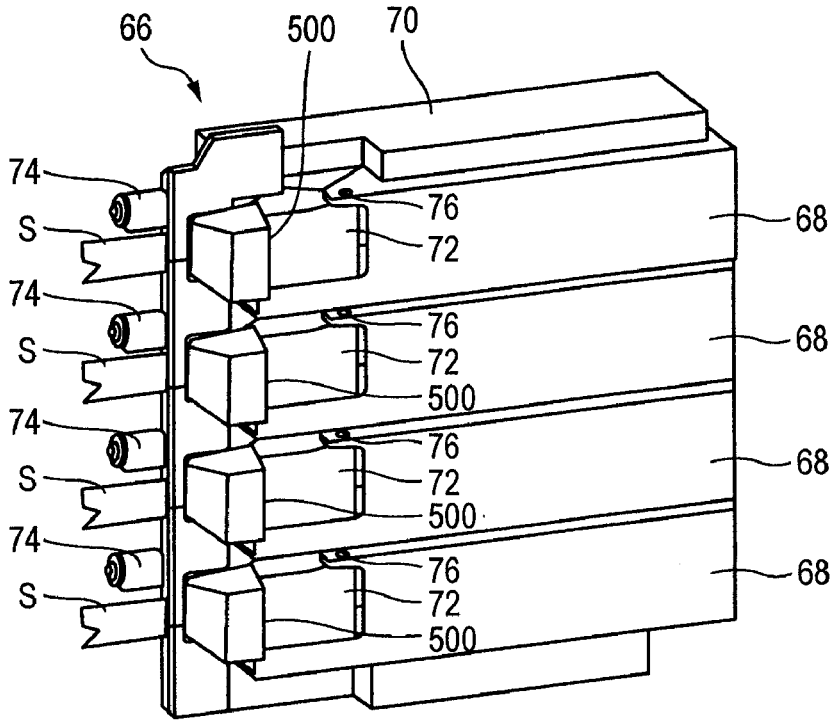
FIGS. 4A and 4B are Perspective views each showing an part of an image forming apparatus in accordance with a third embodiment.
Figure 4B:
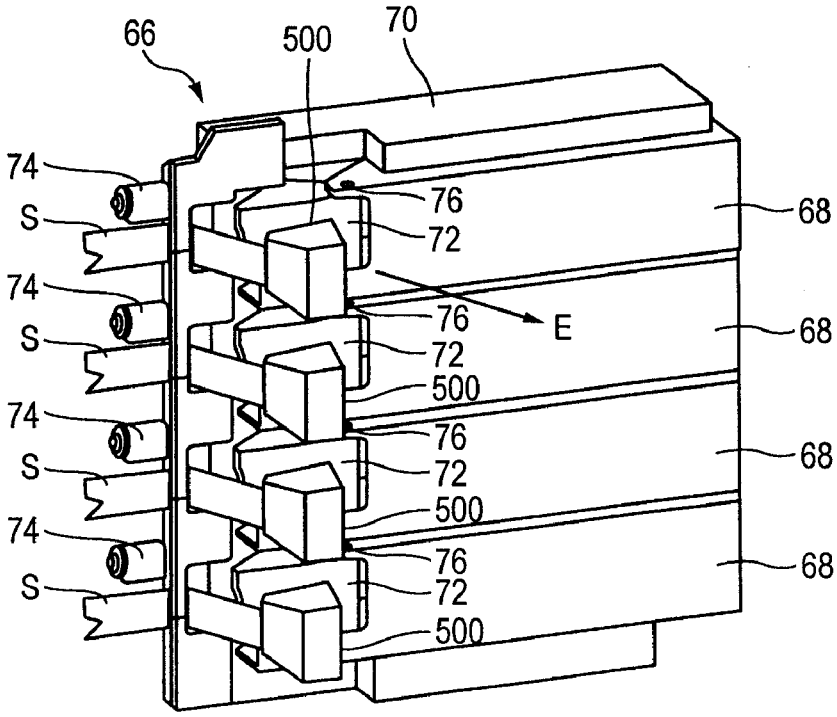
Figure 5:
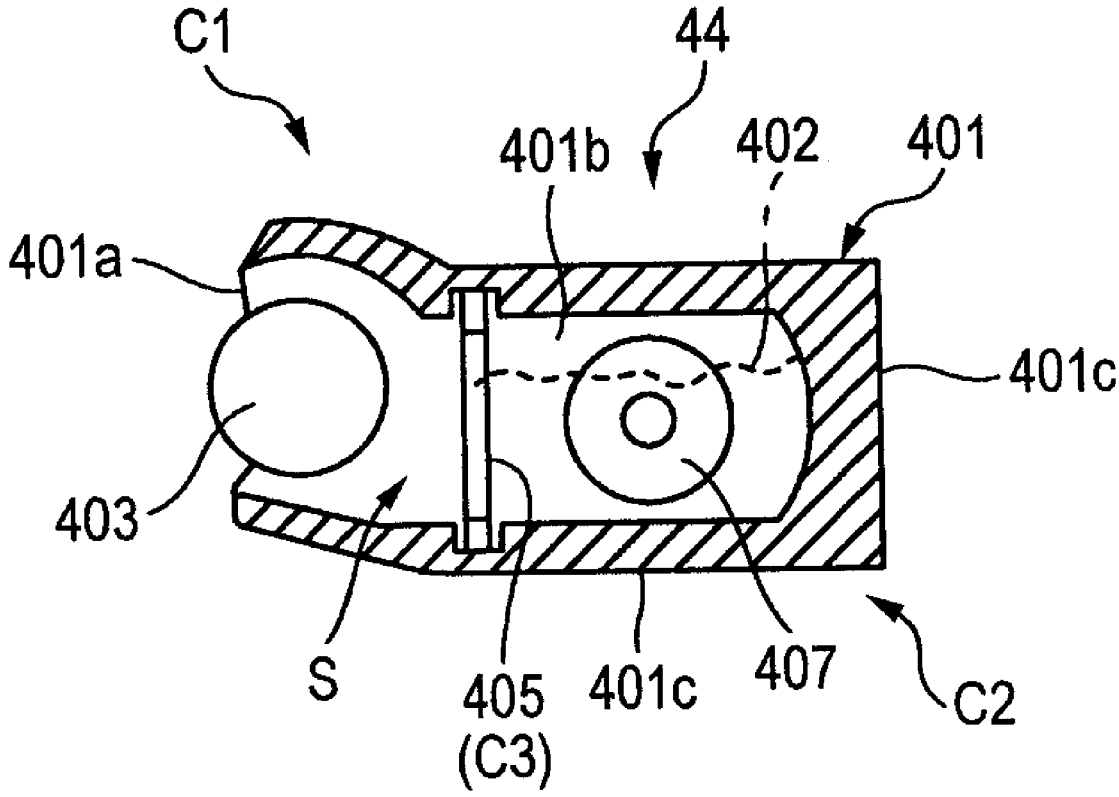
FIG. 5 is a side view showing a schematic configuration of a development device 44 and a sealing member S.

FIG. 1 is a configuration view showing a configuration of an image forming apparatus in accordance with an exemplary embodiment of the invention. FIG. 2A is a perspective view showing a development device unit in accordance with a first exemplary embodiment. FIG. 2B is a perspective view showing an image forming apparatus holding the development device unit in accordance with the first exemplary embodiment. FIG. 3A is a perspective view showing a development device unit in accordance with a second exemplary embodiment. FIG. 3B is a perspective view of an image forming apparatus holding the development device unit in the second exemplary embodiment. FIGS. 4A and 4B are perspective views each showing a part of the image forming apparatus in accordance with a third exemplary embodiment. FIG. 5 is a side view showing a schematic configuration of a development device 44 and a sealing member S.

As shown in FIG. 1, an image forming apparatus 10 has an image forming apparatus main body 12. In the lower part of the image forming apparatus body (housing) 12, a paper feed device 14 is disposed. In addition, in the upper part of the image forming apparatus body 12, a paper output part 16 is formed.

The paper feed device 14 has a paper tray 18. A large number of paper sheets are stacked in the paper tray 18. Above one end of the paper tray 18, a feed roll 20 is disposed. In addition, a sorting roll 22 is disposed in such a manner as to face the feed roll 20. A sheet of paper at the highest position is picked up by the feed roll 20. The sheet is sorted by cooperation of the feed roll 20 and the sorting roll 22, and is transported.

The sheet transported from the paper tray 18 is temporarily stopped by a resist roller 24, and is allowed to pass between an image holding body unit 26 and a transfer unit 28 described later, and a fixing device 30 at a prescribed timing, and discharged into the paper output part 16 by a paper output roller 32.

In the image forming apparatus main body 12, an image holding body unit 26, the transfer unit 28, a power source unit 34, and a control part 36 are disposed. In this exemplary embodiment, for example, four image holding bodies 40 for holding an image which is transferred to the transport belt 60 or the paper sheet transported by the transport belt 60, and the development devices (image forming units) 44 for developing a latent image formed on each image holding body 40 are incorporated in a frame body 106 as a separate body to be included in the image holding body unit 26. Therefore, each image holding body 40 is rotatably supported by the frame body 106. Alternatively, the image forming unit may also be configured such that the image holding body 40 is disposed in the development device 44, and such that the image holding body 40 is rotatably supported by the housing of the development device.

Around each image holding body 40, the image holding body unit 26 has a charging device 42 including a charging roll for uniformly charging the image holding body 40, the development device 44 for developing a latent image formed on each image holding body 40 by a developer (toner), a charge eliminating device 46 for eliminating electric charges on the image holding body 40 after transfer, and a cleaning device 48 for removing the developer remaining on the image holding body 40 after carrying out transfer. The image holding body unit 26 is configured detachably with respect to the image forming apparatus main body 12.

Herein, by reference to FIG. 5, the development device 44 and the sealing member S will be described.

As schematically exemplified in FIG. 5, the development device 44 can be roughly divided into a development chamber (development part) C1 including a developer holding body (development roller) 403 and the like, a stirring chamber (developer accommodation part) C2 for holing and stirring a developer (toner) 402, and a connection part C3 for connecting the development chamber C1 and the stirring chamber (developer accommodation part) C2.

Then, the toner stirred in the stirring chamber C2 is successively supplied from the connection part C3 disposed at the central part in the direction of axis of the developer holding body 403 to the development chamber C1.

Whereas, the overall configuration of the development device 44 includes a housing 401 including (i) an opening 401*a* facing the image holding body 40 on which an electrostatic latent image is formed, and the developer accommodation part C2 for accommodating therein a developer 402, (ii) the developer holding body 403 rotatably attached in the vicinity of the opening 401*a* of the housing 401, for holding the developer 402 accommodated in the developer accommodation part C2, and transporting it to the development region facing the image holding body 40, and (iii) the sealing member S bonded at the site (i.e., the connection part C3) occurring between the developer holding body 403 and the developer accommodation part C2 of the housing 401, and the sealing member S to be peeled off and removed immediately before use.

The housing 401 is generally formed of a plastic molded product, but it is not particularly limited thereto. The developer 402 is a powder-like dry developer. Specifically, it may be either of one-component developer containing a toner, or a two-component developer containing a toner and a carrier.

The developer holding body 403 is generally the one in the form of a roll, but it is not particularly limited thereto.

Further, a reference numeral 407 in FIG. 5 is a stirring transport rotary body (auger) for transporting the developer 402 accommodated in the developer accommodation part C2 in a prescribed direction with stirring. Incidentally, in an actual apparatus, in the housing 401, there are disposed necessary constituent components according to the kind of the applied developer 402.

The sealing member S is for preventing the developer 402 accommodated in the developer accommodation part C2 of the housing 401 from moving to the side on which there is the developer holding body 403 (development part C1), and leaking to the outside before use of the development device 44.

Alternatively, the sealing member S may also be bonded to a partition frame plate 405 detachably mounted with respect to the site (connection part C3) which is between the development part C1 including the developer holding body 403 of the housing and the developer accommodation part C2 of the housing 401. In this case, the partition frame plate 405 remains as it is on the housing 401 side after removal of the sealing member S. However, it is enough to dispose a necessary supply port appropriately in the partition frame plate. When the partition frame plate 405 is adopted, the bonding operation of the sealing member S is easier to carry out as compared with such a case as direct bonding at a prescribed site in the housing 401. Further, even for reuse of the development device 44, steps therefor become easy to take.

Incidentally, in FIG. 5, the free end of the sealing member S extends on the front side in the vertical direction of the drawing of the sealing member S. As described later, a first hole provided in the development device 44, a third hole provided in the frame body, and a second hole provided in the image forming apparatus are provided in such a manner as to overlap one another (communicate with one another). Thus, the free end of the sealing member S is pulled to the outside of the image forming apparatus body through the first to third holes.

Further, in FIG. 1, four developer cartridges 50 are mounted on the lateral side toward the front of the image holding body unit 26.

The respective developer cartridges 50 are for toners in respective colors of magenta (M), yellow (Y), cyan (C), and black (K). Each developer cartridge 50 integrally includes a supplying developer accommodation part 52 and a recovered developer accommodation part 54. The supplying developer accommodation part 52 accommodates a toner (developer) in each color to be supplied to the development device 44. The recovered developer accommodation part 54 accommodates a toner in each color removed from the image holding body 40 by the cleaning device 48.

Each optically writing device 56 includes a laser exposure device. It is on the rear surface side of the image holding body unit 26, and is located at a position corresponding to each image holding body 40. It is configured so as to expose a laser to the uniformly charged image holding body 40, and to form a latent image.

The transfer unit 28 is on the front side of the image holding body unit 26, and located in the longitudinal direction with respect to the image holding body unit 26. In the transfer unit 28, the transport belt 60 is hung over two support rolls 58 disposed in the vertical direction. In this exemplary embodiment, the transport belt transports a sheet of paper. Further, a transfer roll 62 is disposed opposite to each image holding body 40 across the transport belt 60 therebetween.

Herein, the image holding body unit 26 in accordance with a first example will be described.

As shown in FIG. 2A, the image holding body unit 26 includes a body of an image holding body unit (frame body) 106A, charge eliminating lamp bars 108 as the charge eliminating devices 46, connection parts 112 each to be connected to the recovered developer accommodation part 54 of each developer cartridge 50, and the like.

In the longitudinal direction of the development roller (a reference numeral 403 of FIG. 5), as the sealing member for unsealably sealing the connection part (the reference sign and numeral C3 of FIG. 5), the connection part supplying a toner from the stirring chamber (the reference sign and numeral C2 of FIG. 5) to the development chamber (the reference sign and numeral C1 of FIG. 5), the sealing member S is bonded by, for example, an adhesive.

The sealing member S is selected longer than the longitudinal dimension of the development chamber C1, i.e., the longitudinal dimension of the image holding body unit 26A. Thus, the edge 200 of the sealing member S is pulled in the direction of axis of the development roller, thereby to be pulled off therefrom. As a result, the opening is opened, resulting in a toner-suppliable state.

The sealing member S has no particular restriction. However, for example, a lamination of a soft urethane foam and a PET film by a self-adhesive tape, or the one formed by thermocompressing a sheet-like soft urethane foam can be used.

Further, in one side surface (the right-side surface in FIG. 2A) 150A of the image holding body unit main body 106A, a third hole 300 for allowing the edge 200 of the sealing member S to be drawn out on the extension in the longitudinal direction (in the direction indicated with an arrow D in FIGS. 2A and 2B) is disposed so as to communicate in an overlapping manner with the first hole (not shown) disposed in the development device 44. The holes are disposed correspondingly to respective connection parts C3.

Incidentally, the edge 200 of each sealing member S includes a grasping part 200*a* disposed therein so as to be easily grasped by a user.

On the other hand, as shown in FIG. 2B, in one side surface of the image forming apparatus body 12 in accordance with the first exemplary embodiment, a closable cover 64 is disposed. On the one end of the closable cover 64, a rotary fulcrum not shown is disposed. The closable cover 64 is rotatably opened and closed about the rotary fulcrum as the center as indicated with an arrow A in the drawing.

In the image forming apparatus body 12, on the side on which the closable cover 64 is disposed, a developer supply control device 66 (dispenser) is disposed. The developer supply control device 66 includes, for example, four developer cartridge holding parts 68 holding their respective developer cartridges 50. The developer supply control device 66 supplies, to the stirring chamber C2, the developer accommodated in the supplying developer accommodation part 52 of each developer cartridge 50 held by the developer cartridge holding part 68 and thus mounted in the image forming apparatus body 12.

At each one end of the developer cartridge holding parts 68, the rotary fulcrum not shown is disposed. Thus, the developer cartridge holding part 68 moves about the rotary fulcrum as the center as indicated with an arrow B in the drawing. Therefore, when the closable cover 64 is opened, and the developer cartridge holding part 68 is moved in the direction away from the image forming apparatus body 12, the developer cartridge 50 is detached from the image forming apparatus body 12. Thus, as indicated with an arrow C in the drawing, it becomes possible to take out the developer cartridge 50 from the developer cartridge holding part 68.

Then, when the developer cartridge 50 is inserted into the developer cartridge holding part 68 with the developer cartridge holding part 68 away from the image forming apparatus body 12A, and the developer cartridge holding part 68 is moved in a direction coming closer to the image forming apparatus body 12A, the developer cartridge 50 is mounted in the image forming apparatus body 12A.

Further, on the front side surface side of the image forming apparatus body 12A, an operation panel 38 is disposed. The operation panel 38 includes a display part for displaying the prescribed contents under the control of the control part 36, and a button not shown for receiving the operation from a user. The operation received through the button is outputted to the control part 36.

On the front side in such a state that the developer cartridge holding part 68 is accommodated, the grasping part 200*a* of the edge 200 of each sealing member S extending from the connection part C3 of the development device 44 accommodated in the image forming apparatus body 12A through the first hole, the third hole 300 and further the second hole 400 is drawn out to the outside from the image forming apparatus body 12A.

Further, the first to third holes overlap one another, and communicate with one another. Even when the positions of respective holes are misaligned, it is possible to draw out the edge of the sealing member S. However, in consideration of the ease and the operability for draw out the sealing member S, at least parts thereof may overlap one another in the direction of pulling out D of the sealing member, and communicate with one another.

Incidentally, in the case of a configuration in which the side surface 150A of the image holding body unit body 106 is exposed with the closable cover 64 of the image forming apparatus body 12A opened, the second hole 400 of the image forming apparatus body 12A becomes unnecessary. However, in view of the strength of the housing of the image forming apparatus, the side surface 150A of the image holding body unit body 106 may be a non-exposed configuration.

With the image holding body unit 26A and the image forming apparatus body 12A in accordance with the first exemplary embodiment configured in the foregoing manner, a user carries out the operation of grasping by hand and drawing out each grasping part 200*a* of the edges 200 of the sealing members S with the closable cover 64 of the image forming apparatus body 12A opened. As a result, each sealing member S closing the connection part C3 is pulled off, resulting in a toner-suppliable state.

At this step, it is not necessary to detach the image holding body unit 26A from the image forming apparatus body 12A as in the related art. This reduces the time and effort of a user, and avoids the situation in which a user touches the member in the inside of the body or the image holding body unit 26A by mistake. Thus, the safety is kept, and useless image deterioration or the like is prevented.

Incidentally, the body of the image holding body unit 106A is detached from the front surface of the image forming apparatus body 12A by opening the apparatus front surface cover 600. Mounting the body of the image holding body unit 106A is carried out by the following procedure.

First, before mounting the body of the image holding body unit 106A into the image forming apparatus main body 12A, the edge 200 of each sealing member S is pulled to the outside from the image forming apparatus body inside through the second hole 400. At this step, in order to prevent the sealing member S from being pulled off, the procedure may be carried out in the following state. Namely, the body of the image holding body unit 106A is positioned sufficiently in proximity to the image forming apparatus body 12A. Alternatively, a part thereof is inserted in the mounting opening (not shown) of the body of the image holding body unit 100A disposed in the image forming apparatus body 12A.

Then, for every color, the operation of pulling the edge 200 of each sealing member S through the second hole 400 to the outside is completed. Then, the body of the image holding body unit 106A is mounted in the image forming apparatus body 12A, and the apparatus front surface cover is closed.

Incidentally, the same also applies to the case where the development device 44 is mounted in the body of the image holding body unit 106A.

Then, by reference to FIGS. 3A and 3B, an image holding body unit 26B and an image forming apparatus body 12B in accordance with a second exemplary embodiment will be described.

Incidentally, the basic configuration is the same as that of the first exemplary embodiment shown in FIGS. 2A and 2B. Therefore, the same reference numerals and signs are given, and a description thereon is omitted.

The different point from the first exemplary embodiment is the position of each penetration hole disposed on each side surface of the image holding body unit 26B and the image forming apparatus body 12B.

In the second exemplary example, the positions of each third hole 301 and each second hole 410 disposed in the side surfaces of the image holding body unit 26B and the image forming apparatus body 12B, respectively, are closer to the rear end on the drawing as compared with the first exemplary embodiment. Then, the grasping part 200*a* of the edge 200 of each sealing member S is allowed to face the outside through the third hole 301 and the second hole 410.

With such a configuration, the second hole 410 on the image forming apparatus body 12B side, and the grasping part 200*a* of the sealing member S are in a state hidden by the developer cartridge holding part 68 with the developer cartridge holding part 68 holding the developer cartridge 50 accommodated (the state of the developer cartridge holding parts 68*b* and 68*c* of FIG. 3B).

Then, upon opening the developer cartridge holding part 68 along an arrow B, the second hole 410 on the image forming apparatus body 12B side and the grasping part 200*a* of the sealing member S are exposed. In this state, a user carries out the operation of grasping and drawing out each grasping part 200*a* by hand. As a result, each sealing member S closing the connection part C3 is pulled off, resulting in a toner-suppliable state.

For carrying out the operation; as with the first embodiment, it is not necessary to detach the image holding body unit 26B from the image forming apparatus body 12B as in the related art. This reduces the time and effort of a user, and avoids the situation in which a user touches the member in the inside of the body or the image holding body unit 26B by mistake. Thus, the safety is kept, and useless image deterioration or the like is prevented.

Then, by reference to FIGS. 4A and 4B, a third embodiment will be described.

As shown in FIGS. 4A and 4B, a developer supply control device 66 of an image forming apparatus in a third embodiment has developer cartridge holding parts 68, a developer supply control device body 70, levers 72, rotary fulcrums 76 for the levers 72 to rotate, and connection parts 74 connected to the image holding body unit 26 (see, FIG. 1).

The developer supply control device 66 supplies a prescribed amount of a developer accommodated in the supplying developer accommodation part 52 of the developer cartridge 50 to the image holding body unit 26 (see, FIG. 1) under the control of the control part 36.

Each lever 72 is for moving the position of the developer cartridge 50 held by the developer cartridge holding part 68. Specifically, when the lever 72 is rotated about the rotary fulcrum 76 as the axis with the developer cartridge 50 held by the developer cartridge holding part 68, the developer cartridge 50 is moved along the longitudinal direction of the developer cartridge holding part 68.

Further, as shown in FIG. 4A, at the tip part of each lever 72, a fixing member 500 for preventing the actuation of the lever 72, or the oscillation of the developer cartridge 50 during transport of the image forming apparatus body 12 is detachably attached (see, FIG. 4A). To each of the fixing members 500, the edge of the same sealing member S as that shown in the first and second embodiments is attached.

As a result of this, during transport of the image forming apparatus 10 or the like, the useless actuation of each lever 72, and the oscillation of each developer cartridge 50 can be suppressed by each fixing member 500. This can effectively prevent toner leakage or the like. Further, when a user starts to use the image forming apparatus body 12, as shown in FIG. 4B, each fixing member 500 is detached with the closable cover 64 of the image forming apparatus body 12 opened, and the fixing member 500 is pulled in the direction of an arrow E. As a result, each sealing member S closing the connection part C3 is drawn out, resulting in a toner-suppliable state.

For carrying out the operation, as with the first embodiment and the second embodiment, it is not necessary to detach the image holding body unit 26 from the image forming apparatus body 12 as in the related art. This reduces the time and effort of a user, and avoids the situation in which a user touches the member in the inside of the body or the image holding body unit 26 by mistake. Thus, the safety is kept, and useless image deterioration or the like is prevented.

Up to this point, the invention made by the present inventors was specifically described by way of embodiments. However, it should be construed that the embodiments disclosed in this specification are illustrative in all respects, and are not limited to the disclosed technology. Namely, the technological range of the invention should not be construed as limitative based on the description in the embodiments, but rather construed according to the appended claims, and includes the technologies within the scope of the appended claims, equivalent technologies, and all changes within the scope of the appended claims.

The image forming apparatus in accordance with the present invention is applicable to a laser printer, a full-color printer, an ink jet printer, a fax, or the like.

What is claimed is:

1. An image forming apparatus comprising:

an image forming unit that is detachable with respect to the image forming apparatus, the image forming unit comprising:

a development part that develops, using a developer, an electrostatic latent image held on an image holding body;

a developer accommodation part that accommodates the developer;

a connection part that connects the development part and the developer accommodation part; and a sealing member that seals the connection part, and may be removed, thereby unsealing said connection part, wherein the sealing member can be drawn outside the image forming apparatus in a direction intersecting with a detaching direction of the image forming unit in such a state that the image forming unit is located in a position where the image forming unit performs image formation inside the image forming apparatus, wherein the sealing member can be drawn outside the image forming apparatus through (i) a first hole disposed in the image forming unit, and (ii) a second hole disposed in the image forming apparatus, wherein the first hole and the second hole communicate with each other at least parts thereof in the direction of drawing out of the sealing member.

2. The image forming apparatus according to claim 1, wherein the second hole is provided on an inner side of a closable cover which is disposed in the image forming apparatus.

3. The image forming apparatus according to claim 2, wherein the closable cover is opened and closed when a cartridge which supplies the developer to at least one of the developer accommodation part and the development part is mounted.

4. The image forming apparatus according to claim 1, further comprising:

a developer cartridge that supplies a developer to at least one of the development part and the developer accommodation part, a fixing member that fixes the developer cartridge, wherein the fixing member is attached to the edge of the sealing member projecting from the second hole to the outside.

5. The image forming apparatus according to claim 4, wherein drawing the fixing member outside the image forming apparatus causes the sealing member to be drawn outside the image forming apparatus.

6. The image forming apparatus according to claim 1, further comprising:

a developer cartridge that is detachable with respect to the image forming apparatus, the developer cartridge supplying a developer to at least one of the developer accommodation part and the development part, wherein a drawing direction of the sealing member is different from an attaching and detaching direction of the developer cartridge.

7. The image forming apparatus according to claim 1, further comprising:

a first opening and closing part for attaching and detaching the image forming unit with respect to the image forming apparatus, wherein the sealing member can be drawn in a state where the image forming unit is held in the image forming apparatus and the first opening and closing part is closed.

8. The image forming apparatus according to claim 7, further comprising:

a second opening and closing part for drawing the sealing member from the image forming apparatus, wherein the second opening and closing part can be opened and closed independently from the first opening and closing part.

9. The image forming apparatus according to claim 8, further comprising:

a developer cartridge that is detachable with respect to the image forming apparatus, the developer cartridge supplying a developer to at least one of the developer accommodation part and the development part, wherein the developer cartridge is detachable with respect to the second opening and closing part.

10. An image forming apparatus comprising:

an image forming unit that is detachable with respect to the image forming apparatus, the image forming unit comprising:

a development part that develops, using a developer, an electrostatic latent image held on an image holding body;

a developer accommodation part that accommodates the developer;

a connection part that connects the development part and the developer accommodation part;

a sealing member that seals the connection part, and may be removed, thereby unsealing said connection part;

a plurality of the image forming units are held in a frame body, which is detachable with respect to the image forming apparatus; and the sealing member can be drawn outside the image forming apparatus in such a state that the frame body is held in said image forming apparatus, wherein the sealing member can be drawn outside the image forming apparatus in a direction intersecting with a detaching direction of the image forming unit in such a state that the image forming unit is located in a position where the image forming unit performs image formation inside the image forming apparatus.

11. The image forming apparatus according to claim 10, wherein the sealing member can be drawn outside the image forming apparatus through a first hole disposed in the image forming unit, a second hole formed in the image forming apparatus, and a third hole disposed in the frame body.

12. The image forming apparatus according to claim 11, wherein the first hole, the second hole, and third holes communicate with one another at at least parts thereof in the direction of drawing out of the sealing member.

* * * * *